United States Patent [19]

Decaux

[11] 4,426,748

[45] Jan. 24, 1984

[54] MOTORCYCLE FOR CLEANING THE GROUND

[76] Inventor: Jean-François Decaux, 88 bld. M. Barres, 92200 Neuilly, France

[21] Appl. No.: 247,370

[22] Filed: Mar. 25, 1981

[51] Int. Cl.[3] ..... E01H 1/04

[52] U.S. Cl. ..... 15/83

[58] Field of Search ..... 15/82, 83, 79 A, 340, 15/80

[56] References Cited

U.S. PATENT DOCUMENTS 599,790 1/1898 Osborne ..... 15/82

3,939,528 2/1976 Mossinsohn ..... 15/340

FOREIGN PATENT DOCUMENTS 324016 8/1920 Fed. Rep. of Germany ..... 15/83

*Primary Examiner*—Edward L. Roberts

*Attorney, Agent, or Firm*—Sherman Levy

[57] ABSTRACT

The motorcycle comprises a support rigid with the frame of the motorcycle and at least one cleaning device which is mounted on the support to move between a cleaning position in which it is in contact with the ground and withdrawn position. The cleaning device is coupled to a motor by a transmission. The cleaning device is disposed in a case which is mounted on one side of the motorcycle in the immediate vicinity of the footrest on the same side of the motorcycle. The case has a foot bearing surface and is movable between the aforementioned two positions.

18 Claims, 4 Drawing Figures

MOTORCYCLE FOR CLEANING THE GROUND

The invention relates to a motorcycle, such as a motorized bicycle, moped or motocyclette, equipped with means for cleaning the ground and more particularly the surface of sidewalks by removing excrements left by dogs.

The problem created by unscrupulous dog owners in town areas is not always solved in a satisfactory manner despite efforts on the part of municipal autorities in the form of information, publicity and even warning of penalties addressed at these owners. All these measures have been without effect since most users still ignore the gutter and allow their dogs to relieve themselves on the sidewalks, footpaths or other public places.

Vehicles already exist for cleaning roadways which comprise bushes and a circuit of washing water under pressure.

These vehicles are usually automobiles of large size which cannot travel on the sidewalks or smaller vehicles which travel at low speed and hinder the abundant traffic of vehicles when they return to the roadway. Further, as it concerns vehicles having four wheels, their handling on the sidewalk where many pedestrians circulate is poorly adapted to the winding path they must travel through to effectively clean the whole of the area of the sidewalk. Lastly, these vehicles are not adapted to the picking up of excrements left by dogs on the sidewalks.

An object of the invention is consequently to overcome the various drawbacks and the invention relates to a light vehicle of small size capable of easily circulating between obstacles on the sidewalks, this vehicle being capable of travelling at low speed when in operation and of adapting itself to the speed of automobiles travelling on the road when it must move from one cleaning place to another.

Such a vehicle is consequently efficient, hardly hinders pedestrians and does not hinder the traffic on the road.

Moreover, its handling capability and its speed of displacement between the cleaning places renders it most advantageous.

According to the invention, there is provided a motorcycle for cleaning the ground and in particular for rapidly and efficiently picking up excrements left by dogs on sidewalks, said motorcycle comprising at least one unit provided with cleaning means and mounted to be pivotable between a withdrawn position in which it is spaced from the ground and an operative position in which the cleaning means are in contact with the ground, said cleaning means being rotatable and coupled by transmission means to the motor of the motorcycle.

In a preferred embodiment, the pivotal unit is brought from its withdrawn position to its operative position merely by pressure exerted by the foot, return means returning said unit to the withdrawn position as soon as said pressure ceases, which enables the motorcycle to resume its initial speed for travelling on the road without hindering road users.

In a modification, the motorcycle may have two pivotal units located on each side of the frame and capable of being pivoted toward the ground separately or together.

A motorcycle according to the invention is shown merely by may of example in the accompanying drawings in which.

Figure 1:
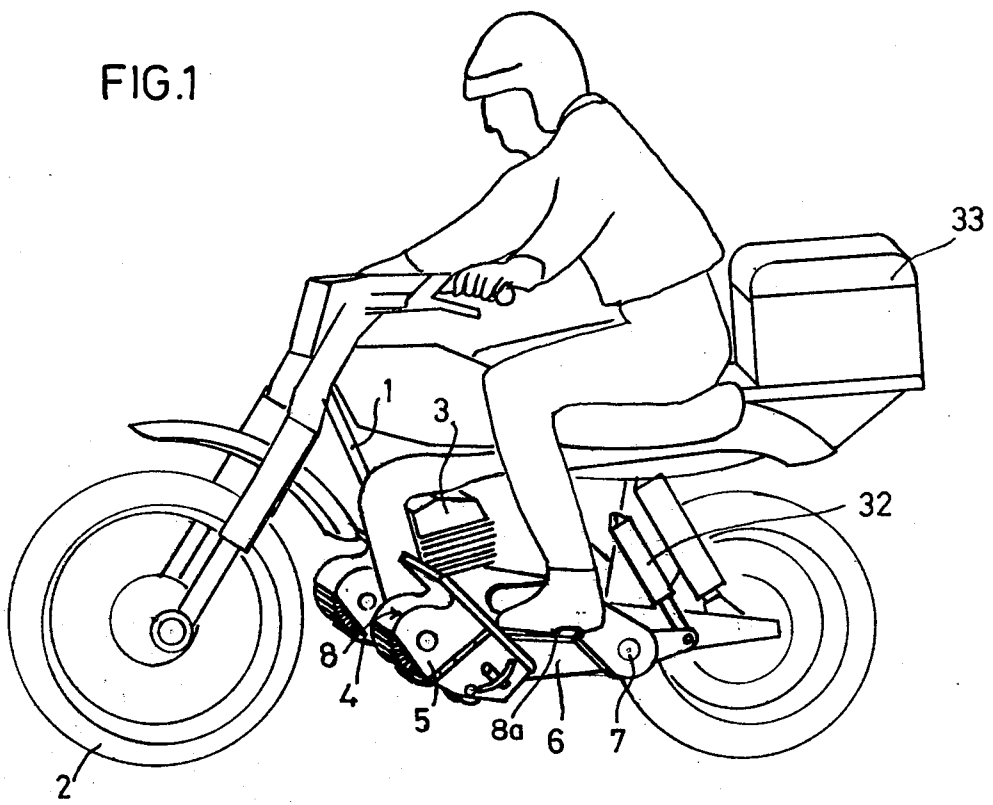
FIG. 1 is an elevational view of the motorcycle with the cleaing means in the raised position.
Figure 2:
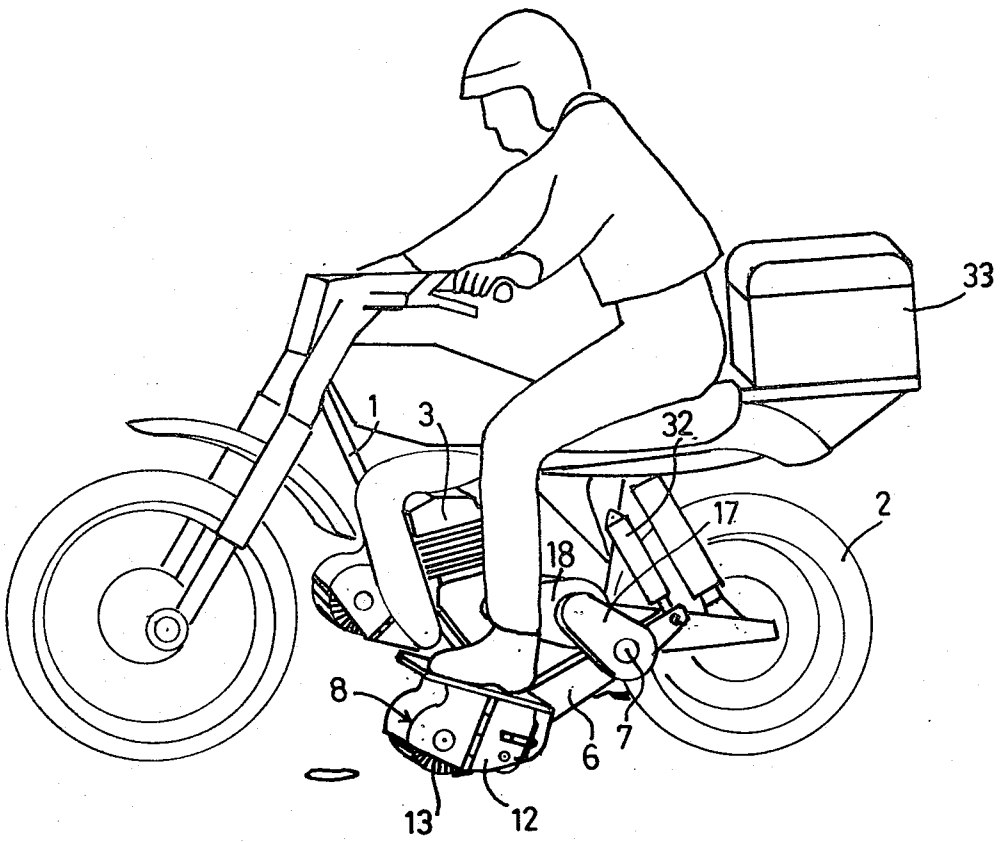
FIG. 2 is a view similar to FIG. 1 in which one of the pivotal units has been brought in contact with the ground.

The motorcycle shown in FIGS. 1 and 2 comprises in the conventional manner a frame 1, two wheels 2 and a driving motor 3. This motorcycle may be a motorized bicycle of 50 cc, a moped of less than 125 cc, or a motocyclette of more than 125 cc.

The feature of the invention resides in the fact that this motorcycle is provided, in the presently-described embodiment, with two pivotal units 4 and 5 which are located on opposite sides of the frame 1 and include cleaning means which may be selectively brought into contact with the ground.

Figure 3:
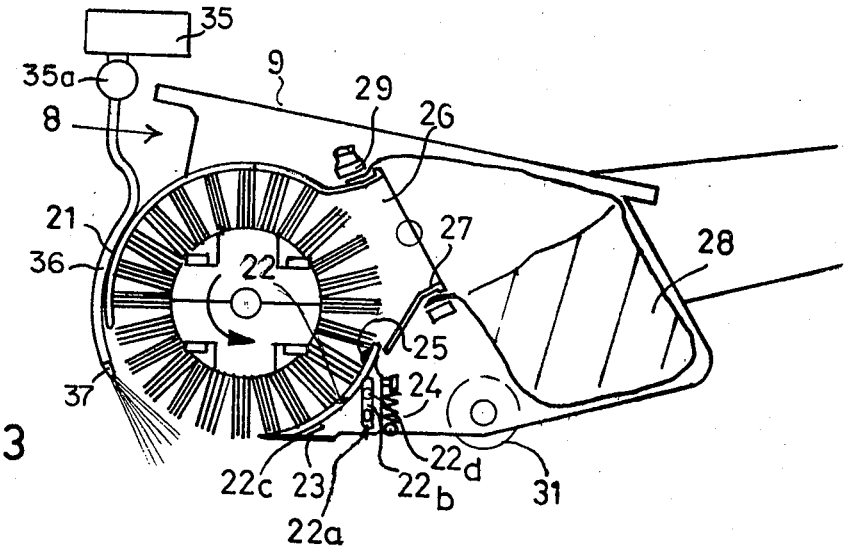
FIG. 3 is a diagrammatic elevational view of one of the cleaning brushes.
Figure 4:
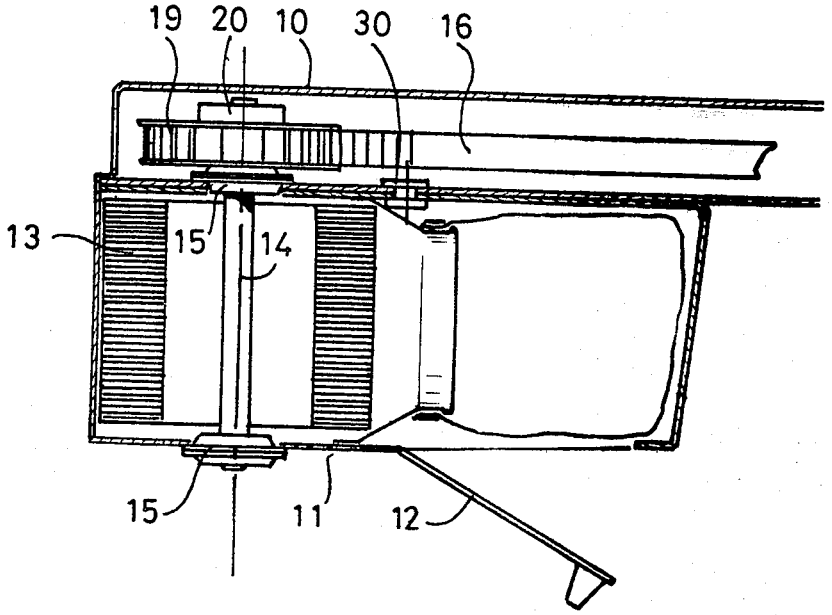
FIG. 4 is a plan view of the brush shown in FIG. 3.
Figure 5:
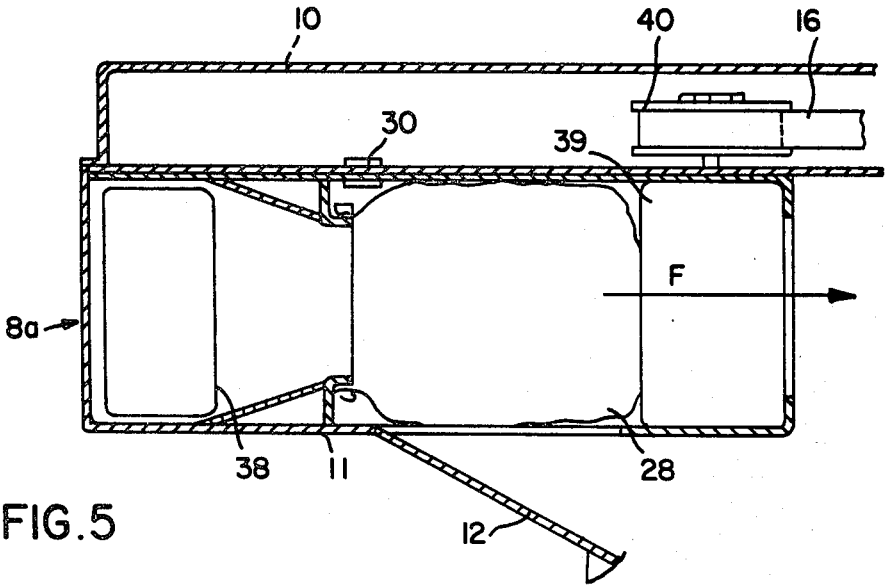

Each unit comprises an intermediate support in the form of an arm 6 pivotally mounted at 7 on the frame of the motorcycle, the front end of this arm terminating in a case 8 (FIG. 3) in which the cleaning means are disposed and which is located in the vicinity of footrest means 8*a* of the motorcycle. Each case comprises an upper wall 9 defining a pedal surface and two lateral side walls 10 and 11, the latter wall including a pivotal door 12 giving access to the interior of each case 8. Mounted in the case 8 of each unit 4 and 5 is at least one brush 13 having stiff bristles which forms the means for cleaning, or more precisely picking up the excrements left by dogs on sidewalks. The brush 13 is mounted on a rotary shaft 14 which is carried at each end by a bearing 15, this brush being driven in rotation through a notched belt 16 connected to the output shaft of the motor 3 of the motorcycle by two intermediate V-belts 17 and 18 (FIG. 2), the notched belt being engaged with the teeth of a sprocket 19 keyed on the end 20 of the shaft 14 of the brush. This brush is exposed in its lower part for contacting the ground and covered in its upper part by a concentric cover 21 and bordered adjacent its exposed part by a deflector 22 mounted on a skid 23 which comes in contact with the ground, this deflector being mounted by a pin and slot arrangement 22*a* so as to be elastically movable toward the brush by the effect of calibrated springs 24 calibrated springs 24 as shown in FIG. 3. The arrangement 22*a* comprises a slot 22*b* formed in a member 22*c* combined with the deflector 22 and two pins 22*d* and 22*e* mounted on the case 8 and slidably engaged in the slot 22*b*. The illustrated clearances between these pins and the ends of the slot 22*b* clearly allow the member 22*c*, and consequently the deflector 22, to move upwardly toward and downwardly away from the brush 13. The spring, 24 anchored at the end on the case 8 and at its other end on the member 22*c*, biases the deflector toward the brush 13. A feature of this deflector 22 is that is has on its inner surface a boss 25 which extends toward the bristles of the brush and is located in the vicinity of a discharge opening 26 whose edge 27 is used for fixing a bag 28 adapted to receive the excrements driven by the brush, this bag being located on the downstream side of the brush relative to its direction of movement and being fixed to the edge 27 of the discharge opening by detachable fixing means 29. These fixing means may be formed by an elastic or flexible tie, an elastic band or a rapidly secured belt.

Further, a feature of the pivotal unit is that it is provided with pivoting means 30 such as a pivot, the latter being adapted to allow the case 8 of the unit 4 or 5 pivot freely so that the case can be shifted angularly relative to the pivotal arm 6 of each movable unit. This pivotal arrangement is adapted to enable the driver of the motorcycle to put in contact with the ground selectively either the pick-up brush 13 or a roller 31 which is located below the lower surface of the case and is capable of bearing against the ground. Consequently, by a slight movement of the foot acting on the pedal surface 9, either the brush or the roller can be brought in contact with the ground so that wear of the bristles of the brush may be avoided on surfaces devoid of any substance to be picked up.

Thus, the driver can selectively lower one or both of the pivotal units so as to bring them in contact with the ground, the displacement of these units from the withdrawn (raised) position to the operative position (in contact with the ground) being achieved simply by means of the foot which depresses the pedal surface 9 in opposition to the action of the force exerted by a return means 32 which constantly upwardly biases the pivotal units so as to return them to the withdrawn position. Thus, as soon as the pressure on the pedal surface 9 ceases, the pivotal units return to the withdrawn position (FIG. 1).

The fact that the bags for receiving the excrements are located on the downstream side of the brush and tangentially with respect to the latter permits receiving all of the substances on the ground, these substances being detached from the bristles of the brush by the boss 25 on the deflectors 22. The bristles of the brush are very stiff and are capable of forcefully engaging the ground and even scratching the latter so as to be capable of detaching dried excrements which adhere to the ground. It will be understood that these brushes may be soaked with water or disinfectant products from a tank 35 by way of a pump 35*a* and a flexible hose 36 and their action may also be accompanied by a spraying through a nozzle 37 before or after their action. The brush may combined with a cleaning roller located at the rear of the brush and adapted to perfect the cleaning of the brush.

As the brushes are driven at high speed by the crankshaft of the motor, they efficiently clean the sidewalk by picking up all excrements thereon.

When the vehicle travels on the sidewalk, its speed may be relatively low so as to avoid hindering pedestrians, but it resumes its initial speed whan it returns to the raod. Consequently, the motorcycle does not hinder the traffic on the road and may be rapidly shifted from one point to another, which is an important advantage bearing in mind the considerable traffic at present existing in town areas.

The motorcycle further comprises a box 33 which receives the used bags 28.

It must be understood that the scope of the invention is not intended to be limited to the embodiment described hereinbefore in respect of which other modifications may be envisaged without departing from the scope of the invention defined by the appended claims.

In a modification, the brushes may be replaced by suction means whereby the pivotal units, and in particular the case 8, can perform the function of suction boxes operating by a suction effect. The rotary means for producing this suction effect may be driven by the motor of the motorcycle in the same way as the rotary brushes are driven.

I claim:

1. A motorcycle for picking up rubbish or the like of small volume, such as excrements of dogs, said motorcycle comprising a frame, footrest means mounted on the frame for the motorcyclist for conventional use of the motorcycle, support means mounted on the frame, at least one unit movably mounted on the support on a given lateral side of the frame and comprising a case, means defining a pedal surface, cleaning means which are located in the case and have an exposed part for cleaning contact with the ground for effecting said picking up, said unit being movable between a cleaning position in which the cleaning means are in contact with the ground and a withdrawn position in which the cleaning means are spaced from the ground, transmission means, connecting the cleaning means to a motor so that the motor can drive the cleaning means, the pedal surface being located in the immediate vicinity of the footrest means in said withdrawn position of the unit whereby the motorcyclist can move the unit to said cleaning position by moving his foot from the footrest means to the pedal surface and depressing the pedal surface.

2. A motorcycle according to claim 1, comprising return means interposed between the frame and the cleaning means for returning the cleaning means to said withdrawn position.

3. A motorcycle according to claim 1, wherein said unit is pivotably mounted on the frame.

4. A motorcycle according to claim 3, wherein said unit comprises an arm mounted to be rotatable relative to the frame, the case being mounted on the arm.

5. A motorcycle according to claim 4, comprising return means for returning the unit to said withdrawn position, the return means being a cylinder device which is connected to the arm adjacent an end of the arm opposed to a second end of the arm adjacent to which second end the case is mounted.

6. A motorcycle according to claim 1 or 2, or 3, or 4, or 5, wherein the pedal surface is defined by an upper planar wall of the case.

7. A motorcycle according to claim 1 or 2, or 3, or 4, or 5, wherein the cleaning means is a brush rotatively mounted in the case and a side of the case which faces the ground is open.

8. A motorcycle according to claim 7, wherein the case comprises a case part which surrounds the brush and has at the rear of the brush relative to the direction of forward travel of motorcycle a discharge opening on an edge of which opening a receiving bag is secured by detachable means.

9. A motorcycle according to claim 8, wherein the rotary brush is a brush having hard bristles and a part of the case surrounding the brush comprises an assembly including a deflector which conforms to the contour of the brush and a skid facing the ground, said assembly being mounted to be movable towards the brush, and elastically yieldable means for biasing the assembly towards the brush, the deflector having on an inner surface thereof a boss located in the vicinity of the discharge opening and in the path of the bristles of the brush.

10. A motorcycle according to claim 8, comprising a box for receiving bags which have been used in combination with the case discharge opening.

11. A motorcycle according to claim 7, wherein the brush has a shaft which is carried adjacent each end by a bearing and a sprocket is fixed to the shaft for driving the brush and is connected to the transmission means so as to be driven.

12. A motorcycle according to claim 7, comprising means for providing the brush with a washing or desinfecting product.

13. A motorcycle according to claim 7, comprising means for spraying the brush with a washing or desinfecting product.

14. A motorcycle according to claim 1 or 2, or 3, or 4, or 5, wherein the case comprises two lateral side walls, one of which walls is provided with a pivotal door.

15. A motorcycle according to claim 1 or 2, or 3, or 4, or 5, wherein the case is mounted to be pivotal about an axis which is transverse to the frame on an intermediate support means which is part of said unit and is mounted relative to the fixed support so as to be movable relative to the fixed support when the unit moves between said two positions, said case being provided on the downstream side of the cleaning means, relative to the direction of forward travel of the motorcycle over the ground, with a roller for bearing against the ground.

16. A motorcycle according to claim 1 or 2, or 3, or 4, or 5, wherein the transmission means comprise a notched belt and two intermediate V-belts.

17. A motorcycle according to claim 1 or 2, or 3, or 4, or 5, wherein said motor is the motor of the motorcycle.

18. A motorcycle according to claim 1 or 2, or 3, or 4 or 5, comprising said cleaning means on both sides of the frame.

* * * * *